US008522379B2

(12) United States Patent
Turner

(10) Patent No.: US 8,522,379 B2
(45) Date of Patent: Sep. 3, 2013

(54) HOSPITAL BED FOOT SECTION WITH CASTER CUTOUTS

(75) Inventor: Jonathan D. Turner, Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 311 days.

(21) Appl. No.: 12/946,446

(22) Filed: Nov. 15, 2010

(65) Prior Publication Data

US 2012/0117731 A1 May 17, 2012

(51) Int. Cl.
*A47B 7/00* (2006.01)

(52) U.S. Cl.
USPC ..... 5/613; 5/618; 5/624; 5/86.1

(58) Field of Classification Search
USPC ..... 5/86.1, 613, 618, 621, 624
See application file for complete search history.

(56) References Cited

U.S. PATENT DOCUMENTS 3,640,566 A * 2/1972 Hodge ..... 297/68
4,847,929 A 7/1989 Pupovic
4,862,529 A 9/1989 Peck
5,096,008 A * 3/1992 Mankowski ..... 180/6.5
5,157,800 A 10/1992 Borders
5,226,187 A 7/1993 Borders et al.
5,230,113 A 7/1993 Foster et al.
5,366,036 A * 11/1994 Perry ..... 180/65.1
5,715,548 A * 2/1998 Weismiller et al. ..... 5/624
6,212,714 B1 * 4/2001 Allen et al. ..... 5/624
6,321,878 B1 11/2001 Mobley et al.
6,408,464 B1 6/2002 Weismiller et al.
6,473,921 B2 11/2002 Brooke et al.
6,499,163 B1 * 12/2002 Stensby ..... 5/618
6,865,775 B2 3/2005 Ganance
6,874,800 B2 4/2005 George
7,014,000 B2 3/2006 Kummer et al.
7,107,636 B2 * 9/2006 Metz et al. ..... 5/426
7,213,279 B2 5/2007 Weismiller et al.
7,302,717 B2 12/2007 Reinke et al.
7,346,942 B2 3/2008 Reinke et al.
7,698,760 B2 4/2010 Rechelhoff et al.
7,757,318 B2 * 7/2010 Poulos et al. ..... 5/624
7,827,632 B2 * 11/2010 Vrzalik ..... 5/425
2004/0034931 A1 * 2/2004 Kummer et al. ..... 5/424
2006/0053555 A1 3/2006 Poulos et al.
2006/0061067 A1 * 3/2006 Kuiken ..... 280/647
2007/0017029 A1 * 1/2007 Wurdeman ..... 5/618
2009/0313758 A1 12/2009 Menkedick et al.
2011/0143898 A1 * 6/2011 Trees ..... 482/142
2012/0137435 A1 * 6/2012 Hornbach et al. ..... 5/510

* cited by examiner

*Primary Examiner* — Robert G Santos
*Assistant Examiner* — Myles Throop
(74) *Attorney, Agent, or Firm* — Barnes & Thornburg LLP

(57) ABSTRACT

A bed has a head end and a foot end. The bed has a deck that can assume a horizontal position and at least one position in which a foot section of the deck is substantially vertical. For instance, the bed may assume a chair position, in which a head section of the deck is pivoted upwardly and the foot section is pivoted downwardly to a substantially vertical position. Casters allow the bed to move relative to the floor. At least one caster is coupled to the foot end of the bed. The foot section of the deck is configured to clear the foot end casters when the foot section is in the substantially vertical position.

19 Claims, 3 Drawing Sheets

HOSPITAL BED FOOT SECTION WITH CASTER CUTOUTS

BACKGROUND

This disclosure relates generally to movable patient beds. More particularly, this disclosure relates to patient beds that can assume a horizontal position and a position in which the foot section of the bed can be pivoted to a substantially vertical position.

Some patient beds, such as those commonly found in healthcare facilities and other locations in which health care is provided, have a number of features that may be operated by either a patient or a caregiver. One such feature allows the bed to move from a horizontal position to a chair position. Some examples of such patient beds are the TotalCare® Bed System and the VersaCare® bed, which are available from the Hill-Rom Company, Inc.

SUMMARY

The present invention comprises one or more of the features recited in the appended claims and/or the following features which, alone or in any combination, may comprise patentable subject matter.

According to one aspect of this disclosure, a bed includes a base having a head end and a foot end longitudinally spaced from the head end, a plurality of casters supporting the base, where the plurality of casters includes a pair of foot end casters coupled to the foot end of the base, a frame supported by the base, and a deck supported by the frame. The deck is configured to support a mattress. The deck includes at least a head section and a foot section spaced from the head section. At least the head and foot sections are pivotable relative to the frame. The foot section is pivotable relative to a remainder of the deck from a first position to a second position in which the foot section is substantially perpendicular to the base. The foot section has a first end pivotably coupled to the remainder of the deck and a second end longitudinally spaced from the first end. The first end has a first width and the second end has a second width. The second width is smaller than the first width to define a substantially "t" shaped foot section.

The second end of the foot section may include a pair of laterally spaced cutout regions, each of which is defined to allow at least a portion of one of the foot end casters to be positioned therein. The cutout regions may have a substantially square shape. The foot section may have a pair of laterally spaced sides intersecting the first and second ends, where each of the cutout regions is located adjacent one of the laterally spaced sides. Each of the foot end casters has a width, and the difference between the first width and the second width may be greater than the width of the foot end casters.

The bed may include a bed controller operably coupled to the foot section and a user input-output device coupled to the bed controller, where activation of the user input-output device moves the foot section to a position in which at least a portion of each of the foot end casters is positioned in one of the cutout regions. The foot section may be moved to a position in which the foot section is at an angle of approximately 90 degrees from horizontal.

According to another aspect of this disclosure, a bed, includes a base having a head end and a foot end longitudinally spaced from the head end, a plurality of casters supporting the base, the plurality of casters including a pair of casters coupled to the foot end of the base, a frame supported by the base, and a deck supported by the frame. The deck is configured to support a mattress. The deck includes at least a head section and a foot section spaced from the head section. At least the head and foot sections are pivotable relative to the frame. The foot section is pivotable relative to a remainder of the deck from a first position to a second position in which the foot section is substantially perpendicular to the base. The foot section has first and second longitudinally spaced ends and first and second laterally spaced sides, where each of the first and second sides has a first edge intersecting the first end, and a second edge intersecting the first edge to define a cutout region.

The second edge may be substantially perpendicular to the first edge. The second edge may be substantially parallel to the first end of the foot section. The first edge may be substantially perpendicular to the first end of the foot section. Each of the first and second sides may include a third edge intersecting the second edge. The third edge may be substantially perpendicular to the second edge. The third edge may intersect the second end of the foot section. The third edge may be substantially perpendicular to the second end of the foot section. The third edge and the first edge may be substantially parallel.

According to a further aspect of this disclosure, a bed includes a base having a head end and a foot end longitudinally spaced from the head end, a plurality of casters supporting the base, the plurality of casters including a pair of casters coupled to the foot end of the base, a frame supported by and movable relative to the base, and a deck supported by the frame. The deck is configured to support a mattress. The deck includes at least a head section and a foot section spaced from the head section. At least the head and foot sections are pivotable relative to the frame. The foot section is pivotable relative to a remainder of the deck from a first position to a second position in which the foot section is substantially perpendicular to the base. The foot section has a first end pivotably coupled to the remainder of the deck and a second end longitudinally spaced from the first end. The first and second ends cooperate to define a pair of cutout regions, each of which is configured to permit passage therethrough of at least a portion of one of the foot end casters.

The foot section may have first and second laterally spaced sides intersecting the first and second ends, where each of the cutout regions is located adjacent one of the laterally spaced sides. The first end of the foot section may have a first width, the second end of the foot section may have a second width, the cutout regions may be spaced from each other by the second width, and the second width may be smaller than the first width. The difference between the first and second widths may be greater than a width of the foot end casters.

BRIEF DESCRIPTION OF THE DRAWINGS

The detailed description particularly refers to the following figures, in which.

The same reference numbers may be used to refer to like components in the several drawings.

DETAILED DESCRIPTION

Figure 1:
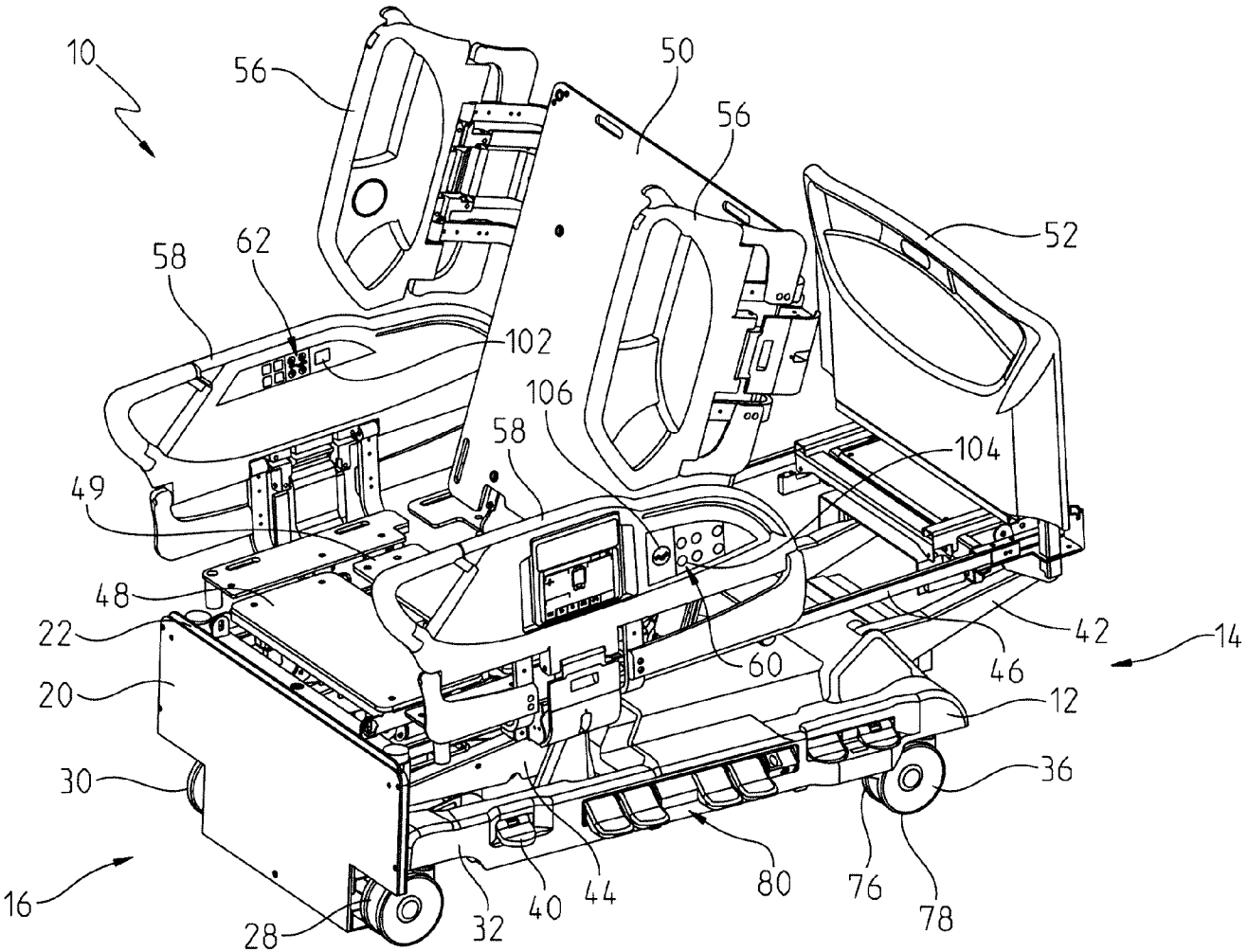
FIG. 1 is a perspective view of a bed in a chair position.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Figure 2:
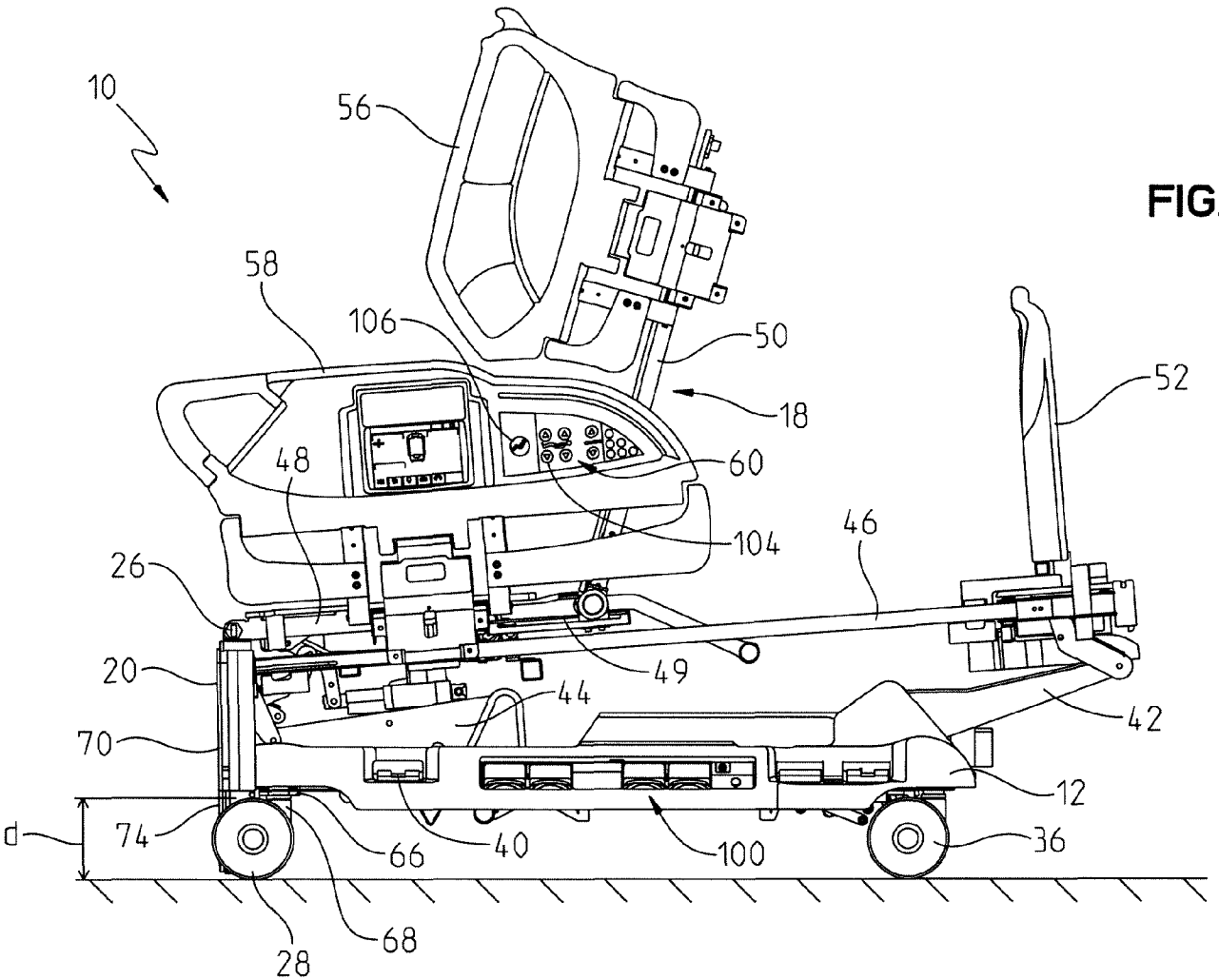
FIG. 2 is a side view of the bed of FIG. 1 in a chair position.

Referring to FIGS. 1-2, a bed 10 is shown. While the bed 10 has a flat or horizontal position, FIGS. 1-2 show the bed 10 in a chair position. The bed 10 includes a base 12, which has a head end 14 and a foot end 16 spaced from the head end 14.

The base 12 is supported by a pair of foot end casters 28, 30, and a pair of head end casters 36, 38 (the view of the head end casters 38 being obstructed by the bed 10). The casters 28, 30 are coupled to the base 12 near the foot end 16. The casters 36, 38 are coupled to the base 12 near the head end 14. The casters 28, 30, 36, 38 each include one or more wheels that movably support the bed 10 relative to a floor or other surface, in one or more directions (e.g. forward and reverse). Each of the casters 28, 30, 36, 38 is configured to swivel, however this need not be the case. In the illustrated embodiment, the casters 28, 30, 36, 38 are in the range of about 5 to 6 inches high, although other sizes of casters may be used.

The base 12 and/or one or more of the casters 28, 30, 36, 38 may have an electronic or mechanically-controlled brake or brake/steer mechanism coupled thereto. Some examples of suitable casters and braking systems for beds are disclosed in U.S. Pat. Nos. 6,321,878; 6,473,921; 6,865,775; 6,874,800; 7,014,000; 7,302,717; 7,346,942; and 7,698,760.

A frame 46 is coupled to and supported by the base 12. A lift mechanism, which includes a pair of head end lift arms 42 and a pair of foot end lift arms 44, is configured to raise and lower the frame 46 relative to the base 12.

A deck 18 is coupled to and supported by the frame 46. The deck 18 is configured to support a mattress (not shown), which, in turn, may support a person positioned thereon. The deck 18 has a number of sections including, in the illustrated embodiment, a foot section 20 and a head section 50. The deck 18 also includes a torso section which, in the illustrated embodiment, includes a thigh section 48 and a seat section 49. In other embodiments, the torso section may include a single deck section (e.g. a seat/thigh section) rather than the two separate deck sections 48, 49.

At least the foot section 20 and the head section 50 are pivotable, such that the bed 10 may assume a number of positions other than a horizontal position, including a chair position in which the foot section 20 is pivoted downwardly toward the base 12 and the head section 50 is pivoted upwardly away from the frame 46. The foot section 20 has a proximal end 22, which is coupled to the thigh section 48 by a pivot 26. The foot section 20 also has a distal end 24, which is longitudinally spaced from the proximal end 22.

The bed 10 has a number of foot pedals 100, including, in the illustrated embodiment, a brake or brake/steer pedal 40. The foot pedals 100 are coupled to and supported by the base 12. The foot pedals 100 may be used by a caregiver to change the position of the bed 10, activate or deactivate one or more of the caster brakes, or cause some other action to occur at the bed 10. The pedal 40 is configured to, when activated, brake (i.e. stop forward or backward rotation of the wheels) the casters 28, 30, 36, 38 and/or to stop the casters 28, 30, 36, 38 from swiveling.

Typically, the bed 10 includes a number of siderails, such as opposing head-end siderails 56 and opposing foot-end siderails 58, as well as a pair of endboards (e.g. a headboard and a footboard, not shown), however, all of these elements are not required for the purposes of the present disclosure.

The base 12 includes a pair of laterally spaced foot end caster supports 32 (the view of one of which is obstructed by the bed). The casters 28, 30 each include a carrier 68, which rotatably supports the caster wheel or wheels for movement of the bed relative to a floor surface. The carrier 68 is coupled to a stem 66. In the illustrated embodiment, the carrier 68 can swivel relative to the stem 66, but this is not required. The stem 66 is fixedly coupled to a distal end of the foot end caster support 32. The casters 36, 38 are coupled to the head end of the base 12.

Figure 3:
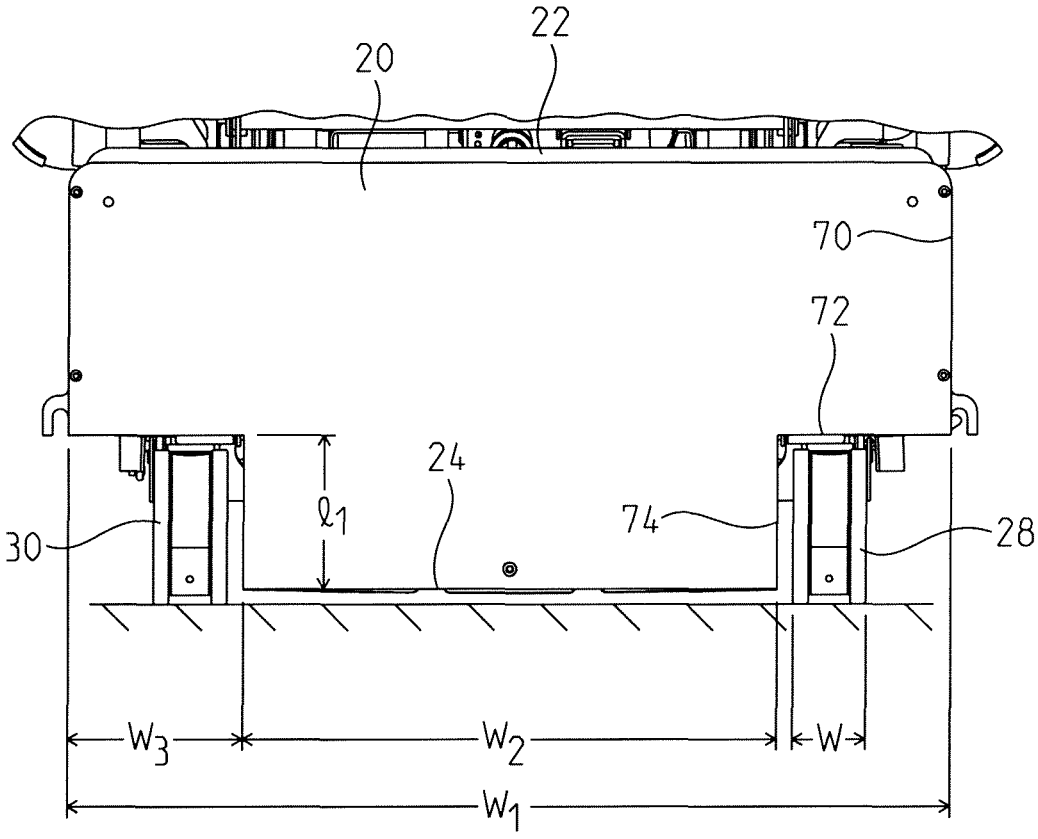
FIG. 3 is a partial front elevation of the bed of FIG. 1, with the foot section pivoted downwardly to a substantially vertical position.

Referring to FIG. 3, the foot section 20 of the deck 18 has a substantially "t" shaped design. The width $w_1$ of the proximal end 22 of the foot section 20 is greater than the width $w_2$ of the distal end 24. Each of the laterally spaced sides of the foot section 20 has an edge 70, which intersects the proximal end 22; an edge 72, which intersects the edge 70; and an edge 74, which intersects the edge 72. The edge 70 is substantially perpendicular to the proximal end 22 of the foot section 20. The edge 72 intersects the edge 70 at substantially a right angle, and the edge 74 intersects the edge 72 at substantially a right angle. The corners at which the edges 70, 72 and the edges 72, 74 intersect may be squared off, rounded, or any other suitable shape.

The edges 72, 74 define a cutout that is sized to allow passage therethrough of a part of a foot end caster wheel, as shown in FIG. 2. In particular, each of the edges 72 has a width $w_3$ that is greater than the width w of the foot end casters 28, 30, respectively. Each of the edges 74 has a length $l_1$. The length of the cutout may be greater than the diameter d of the wheels of the foot end casters 28, 30, respectively. However, the size of the cutout only needs to be sufficient to allow a portion of the caster wheel to extend through the foot section. In other words, the casters need to extend through the cutouts only as much as needed to clear the foot section when it is in the substantially vertical position.

In the illustrated embodiment, the edges 70, 74 are substantially parallel to the laterally spaced sides of the foot section 20, while the edge 72 is substantially parallel to the longitudinally spaced ends 22, 24 of the foot section 20.

In other embodiments, the edges 72, 74 may be "merged" to define an arc-shaped cutout rather than a square or rectangular shaped cutout. In general, the cutouts located at the distal end 24 of the foot section 20 may be any suitable shape to accommodate the foot end caster wheels when the foot section 20 is in the substantially vertical position.

The bed 10 has a number of electronically controlled functions, which may be activated or deactivated by a patient or caregiver using an input-output device, such as one of the foot pedals 100, a patient input-output device 62, or a caregiver input-output device 60.

The patient input-output device 62 receives and processes electrical input (e.g. voltage) from number of manually operable controls (such as membrane switches, keys, dials, levers, or the like) coupled to the patient input-output device 62, which enable a patient to activate and deactivate certain bed functions when the patient is positioned on the bed 10. For example, some beds permit the patient to raise and lower the bed or change the position of certain sections thereof by touching these controls. The illustrated patient input-output device 62 includes a control 102, which enables the patient to lower the foot section 20 of the deck 18.

The patient input-output device 62 includes circuitry configured to convey voltage generated by the manually operable controls, including the control 102, to a bed controller (not shown). In the illustrated embodiment, a patient input-output device 62 is mounted to the inwardly facing side of at least one of the siderails 58 of the bed 10 (i.e., facing toward the mattress), but the patient input-output device 62 may be placed in any suitable location that is accessible to a person positioned on the bed 10.

A caregiver input-output device 60 receives and processes electrical input (e.g. voltage) from one or more controls mounted thereto, which enable a caregiver to configure, activate and/or deactivate certain of the electronically controlled bed functions. For example, some beds permit the caregiver to raise and lower the bed or change the position of certain sections thereof, to achieve a chair, CPR, Trendelenburg, or reverse Trendelenburg position, for example, by physically contacting the selected control. The illustrated caregiver input-output device 60 includes a control 104, which enables the caregiver to lower the foot section 20 of the deck 18, and a control 106, which enables the caregiver to place the bed 10 into a chair position in which the head section 50 is elevated and the end 24 of the foot section 20 is rotated downwardly toward the floor 110.

Typically, the controls of the caregiver input-output device 60 include manually operable controls, such as membrane switches, keys, dials, levers, or the like. Some caregiver input-output devices have touchscreen displays, which may include a graphical user interface. The caregiver input-output device 60 includes circuitry configured to convey voltage generated by the controls mounted thereto to the bed controller. In the illustrated embodiment, a caregiver input-output device 60 is mounted to the outwardly facing side of at least one of the siderails 58 of the bed 10 (i.e., facing away from the mattress), but the caregiver input-output device 60 may be placed in any suitable location that is accessible to a caregiver.

Electronically-controlled functions of the bed 10 are managed by the bed controller. The bed controller includes one or more microprocessors or microcontrollers and electrical circuitry located in a housing. Typically, the bed controller housing is mounted to the bed 10, although this need not be the case. In the illustrated embodiment, the bed controller is located between the inwardly facing and outwardly facing sides of each of the siderails 58, so that the patient input-output device 62 and the caregiver input-output device 60 are connected to opposite sides of the bed controller. However, the bed controller may be placed in any suitable location on the bed or elsewhere. The location of the bed controller relative to the bed 10 is not important for the purposes of the present disclosure.

In operation, a patient or caregiver depresses one of the user controls 102, 104, 106 to initiate the lowering of the foot section 20 toward the floor surface. The bed controller actuates actuators (such as linear actuators, hydraulic cylinders, or mechanical linkages) to pivot the foot section 20 relative to the remainder of the deck 18 in a downwardly direction. When the foot section 20 is pivoted to the substantially vertical position, the edges 72, 74 provide clearance for at least a portion of the foot end casters 28, 30 to extend through the cutouts defined thereby. As a result, the foot section 20 may pivot to a position that is 90 degrees or nearly 90 degrees from the horizontal, without requiring any other adjustments to the bed 10 to accommodate the casters 28, 30.

While the illustrated embodiment is an electronically-controlled bed, the foot section 20 may also be used in connection with a manually-adjustable bed, or in connection with an electronically-controlled bed that allows for manual adjustments (in the event of a power failure, for instance).

In operation of a manually-adjustable bed, a caregiver may activate a lever, button, knob, or similar mechanism to "unlock" the foot section 20, and then manually rotate the foot section 20 toward the floor. When the foot section 20 is pivoted to the substantially vertical position, the edges 72, 74 provide clearance for the foot end casters 28, 30 to extend through the cutouts defined thereby. As a result, the foot section 20 may pivot to a position that is 90 degrees or nearly 90 degrees from the horizontal, without requiring any other adjustments to the bed to accommodate the casters 28, 30.

There are many advantages of the present disclosure arising from the various features described herein. It will be noted that alternative embodiments of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A bed, comprising a base having a head end and a foot end longitudinally spaced from the head end, a plurality of casters supporting the base, the plurality of casters including a pair of foot end casters coupled to the foot end of the base, a frame supported by the base, a deck supported by the frame, the deck being configured to support a mattress, the deck including at least a head section and a foot section spaced from the head section, at least the head and foot sections being pivotable relative to the frame, the foot section being pivotable relative to a remainder of the deck from a first position to a second position in which the foot section is substantially perpendicular to the base, the foot section having a first end pivotably coupled to the remainder of the deck and a second end longitudinally spaced from the first end, the first end having a first width and the second end having a second width, wherein the second width is smaller than the first width to define a substantially "t" shaped foot section; wherein the second end of the foot section includes a pair of laterally spaced cutout regions, each of which is defined to allow at least a portion of one of the foot end casters to extend therethrough such that the portion of the one foot end caster is positioned directly beneath the foot section when the foot section is in the second position.

2. The bed of claim 1, wherein each of the cutout regions has a substantially square shape.

3. The bed of claim 1, wherein the foot section has a pair of laterally spaced sides intersecting the first and second ends, and each of the cutout regions is located adjacent one of the laterally spaced sides.

4. The bed of claim 1, wherein each of the foot end casters has a width, and the difference between the first width and the second width is greater than the width of the foot end casters.

5. The bed of claim 1, comprising a bed controller operably coupled to the foot section and a user input-output device coupled to the bed controller, wherein activation of the user input-output device moves the foot section to a position in which at least a portion of each of the foot end casters is positioned in one of the cutout regions.

6. The bed of claim 5, wherein the foot section is moved to a position in which the foot section is at an angle of approximately 90 degrees from horizontal.

7. A bed, comprising a base having a head end and a foot end longitudinally spaced from the head end, a plurality of casters supporting the base, the plurality of casters including a pair of casters coupled to the foot end of the base, a frame supported by the base, a deck supported by the frame, the deck being configured to support a mattress, the deck including at least a head section and a foot section spaced from the head section, at least the head and foot sections being pivotable relative to the frame, the foot section being pivotable relative to a remainder of the deck from a first position to a second position in which the foot section is substantially perpendicular to the base, the foot section having first and second longitudinally spaced ends and first and second laterally spaced sides, wherein each of the first and second sides has a first edge intersecting the first end, a second edge intersecting the first edge to define a cutout region, and wherein the cutout region is defined to allow at least a portion of one of the foot end casters to extend therethrough such that the second edge is positioned directly above one of the foot end casters when the foot section is in the second position.

8. The bed of claim 7, wherein the second edge is substantially perpendicular to the first edge.

9. The bed of claim 8, wherein the second edge is substantially parallel to the first end of the foot section.

10. The bed of claim 9, wherein the first edge is substantially perpendicular to the first end of the foot section.

11. The bed of claim 10, wherein each of the first and second sides includes a third edge intersecting the second edge.

12. The bed of claim 11, wherein the third edge is substantially perpendicular to the second edge.

13. The bed of claim 12, wherein the third edge intersects the second end of the foot section.

14. The bed of claim 13, wherein the third edge is substantially perpendicular to the second end of the foot section.

15. The bed of claim 14, wherein the third edge and the first edge are substantially parallel.

16. A bed, comprising a base having a head end and a foot end longitudinally spaced from the head end, a plurality of casters supporting the base, the plurality of casters including a pair of casters coupled to the foot end of the base, a frame supported by and movable relative to the base, a deck supported by the frame, the deck being configured to support a mattress, the deck including at least a head section and a foot section spaced from the head section, at least the head and foot sections being pivotable relative to the frame, the foot section being pivotable relative to a remainder of the deck from a first position to a second position in which the foot section is substantially perpendicular to the base, the foot section having a first end pivotably coupled to the remainder of the deck and a second end longitudinally spaced from the first end, wherein the first and second ends cooperate to define a pair of cutout regions, each of which is configured to permit passage therethrough of at least a portion of one of the foot end casters such that the portion of the one foot end caster is positioned directly beneath the foot section when the foot section is in the second position.

17. The bed of claim 16, wherein the foot section has first and second laterally spaced sides intersecting the first and second ends, and each of the cutout regions is located adjacent one of the laterally spaced sides.

18. The bed of claim 17, wherein the first end of the foot section has a first width, the second end of the foot section has a second width, the cutout regions are spaced from each other by the second width, and the second width is smaller than the first width.

19. The bed of claim 18, wherein the difference between the first and second widths is greater than a width of the foot end casters.

* * * * *